US005803277A

United States Patent [19]

Alvarez-Momoitio

[11] Patent Number: 5,803,277

[45] Date of Patent: Sep. 8, 1998

[54] MOUNTING SYSTEM FOR SHELVING FOR CROCKERY AND THE LIKE

[76] Inventor: Ignacio Alvarez-Momoitio, Sugurrialde, 20, Sopelana (Vizcaya), D-48600, Spain

[21] Appl. No.: 619,706

[22] PCT Filed: Sep. 29, 1994

[86] PCT No.: PCT/ES94/00095

§ 371 Date: Mar. 29, 1996

§ 102(e) Date: Mar. 29, 1996

[87] PCT Pub. No.: WO96/04822

PCT Pub. Date: Feb. 22, 1996

[30] Foreign Application Priority Data

Aug. 9, 1994 [ES] Spain ..... 9401801

[51] Int. Cl.[6] ..... A47B 43/00

[52] U.S. Cl. ..... 211/188; 108/108; 248/175

[58] Field of Search ..... 211/188, 183, 211/181.1, 194; 108/108, 190; 248/175, 250

[56] References Cited

U.S. PATENT DOCUMENTS

| | | | |
|---|---|---|---|
| 2,600,191 | 6/1952 | Beach | 211/194 |
| 3,214,031 | 10/1965 | McCauley . | |
| 3,225,487 | 12/1965 | Mallalieu | 211/188 |
| 3,316,864 | 5/1967 | Maslow | 211/186 X |
| 4,426,008 | 1/1984 | Olson et al. | 211/194 X |
| 4,732,284 | 3/1988 | Remmers | 211/188 |
| 5,191,985 | 3/1993 | Licari | 211/188 |
| 5,299,690 | 4/1994 | Mund et al. | 211/194 X |
| 5,531,464 | 7/1996 | Maurer et al. | 211/126 X |

FOREIGN PATENT DOCUMENTS

| | | |
|---|---|---|
| 525136 | 1/1954 | Belgium . |
| 9310013 | 9/1993 | Germany . |
| 511342 | 8/1971 | Switzerland . |

*Primary Examiner*—Ramon O. Ramirez
*Attorney, Agent, or Firm*—Alfred M. Walker

[57] ABSTRACT

System for the mounting of shelving for pieces of crockery and the like, consisting of a multiplicity of identical modules (1), stacked vertically and interconnectable through tongue and groove pressure coupling, each of which has lateral and internal protrusions each with blind orifices, to house the rods (6) belonging to the relevant shelves, so that the selves (3) remain separated by a distance equivalent to the length of the modules (1), a minimum distance which is however sufficient to allow the placements of plates, bowls or other prices of crockery on each self, with maximum use of available space.

6 Claims, 3 Drawing Sheets

MOUNTING SYSTEM FOR SHELVING FOR CROCKERY AND THE LIKE

OBJECT OF THE INVENTION

The invention herein relates to a system for the mounting of shelving, which allows for the provision of multiple shelves adequately separated in height to allow the placement thereon of pieces of crockery such as plates, bowls, coffee cups, trays, dessert dishes, etc., together with the contents thereof, thereby obtaining the maximum use of available space.

The system is especially suitable for use in refrigerators, for the purpose of improving the vertical division of same, but is equally useful outside same, wherever space-saving or a better use of available space is required, as for example on a kitchen work-top, on a table for the stacking of dishes whether full or empty, on shelves, etc.

In any event the structure of this system is easily assembled or dismantled, so that apart from the aforesaid characteristics, the space occupied by the system when not in use or while being dismantled is minimal.

BACKGROUND OF THE INVENTION

In relation to refrigerators, one of the areas in which the system is applicable, the sides of the interior of refrigerators usually come with slots which allow the regulation in height of the shelving, meshes or racks, so that starting with an original spacing between the shelves which tends to be in the region of 20 cm., such spacing can be changed by increasing it in some cases and reducing it in others, subject always to certain restrictions dictated by the original structure of the appliance.

Outside the refrigerator or any other similar container, there are known simple or multiple trays, the latter of which are usually two tier, which tend to increase the storage capacity of any determined space, but which obviously offer a very limited level of capacity and usually constitute a single bulky piece which is difficult to store.

In any event, there does not presently exist a system for the mounting of shelving which, starting from a modular design, permits the optimum use of available space on the basis of closely spaced shelves through the placement at different levels of individual pieces of crockery, such as for example plates, bowls, etc., foods containers.

DESCRIPTION OF THE INVENTION

The system which this invention proposes fills this technological gap by offering a simple rational solution with a high level of capacity.

For this purpose and more precisely, the essential element of said system is a small flat module, which basically constitutes a separating leg between shelves, and which has means for attachment for the mesh of the corresponding shelf itself, as well as tongue and groove attachments for coupling to the modules immediately below and above so that a racking effect is achieved with such modules creating a global support for the entire shelving structure which together with another three legs gives the entire structure appropriate stability.

More precisely, each module has at the top two cylindrical parallel and horizontal slots which are intended to hold the ends of the rods belonging to the metal support which constitutes the corresponding shelf, it having been envisaged that such slots should have a cut along their shanks, so that they could act as elastically deformable elements thus giving a maximum hold on the said rods and a better fitting of same.

On the other hand each module has an appendage at its lower end, preferably with a graduated front, with a lateral protuberance close to its open side which acts as a fixing clip, while at its upper end it has a slot to accommodate the appendage of the module immediately above which it will hold so that a perfect fit is achieve between modules which in turn ensures a perfectly perpendicular continuous racking of the elements while same remain attached to each other through the clips which join them.

As a complement to the said structure it has been envisaged that each continuous rack or stack of modules should be fitted at the bottom with a small rectangular foot fitted with a slot as previously described which when fitted to the end of the bottom module would appropriately complete the shelving structure for placement on any type of flat surface.

DESCRIPTION OF THE DRAWINGS

To complement the description which is hereby set out and with a view to a better understanding of the characteristics of the invention, the within specifications are accompanied by a set of drawings which form an integral part of same, and where the following is set out for illustrative purposes but without limiting the scope hereof.

IDEAL CONSTRUCTION OF THE INVENTION

Figure 1:
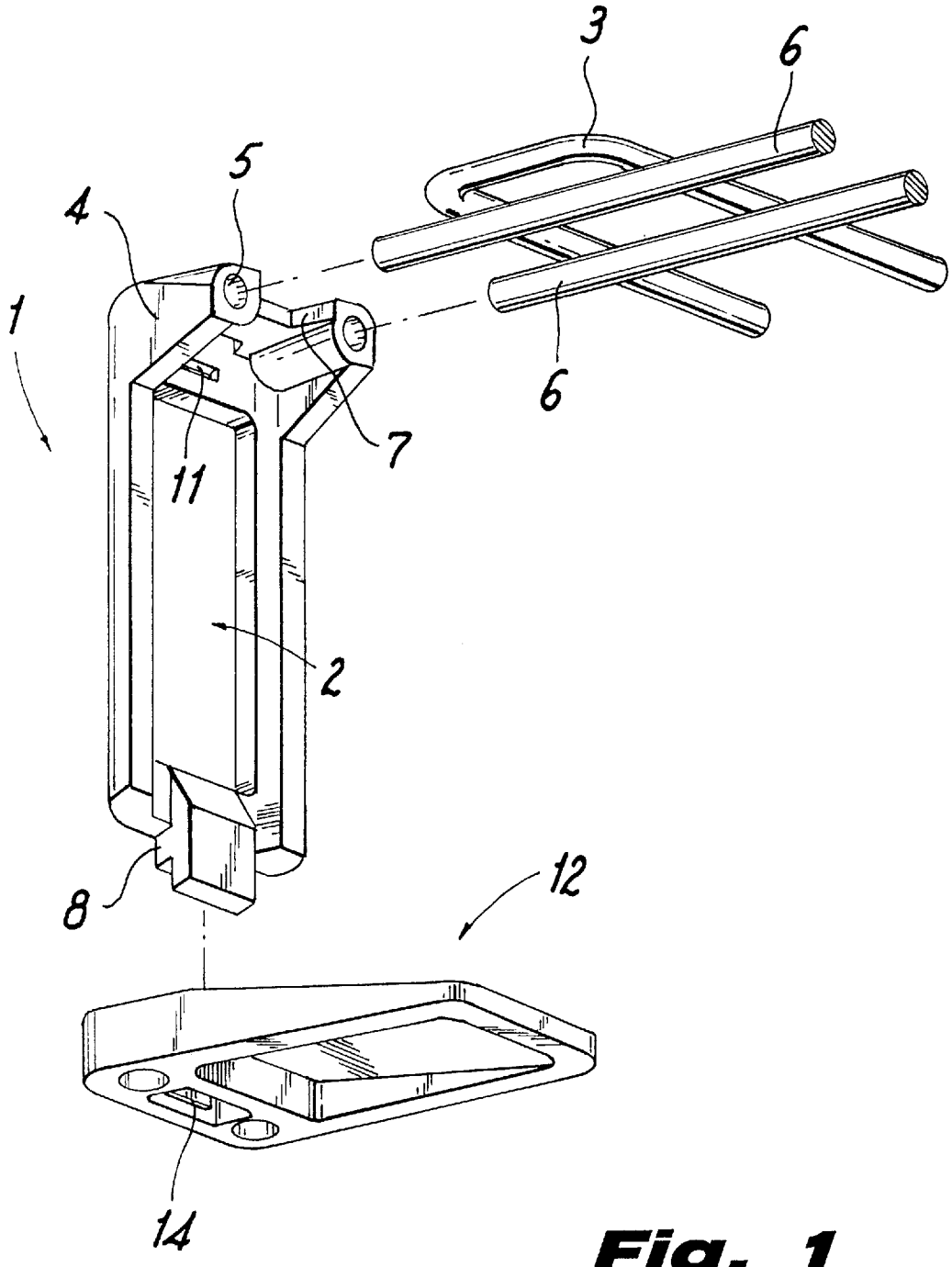
FIG. 1: Shows a view of one of the modules which form part of the shelving assembly for pieces of crockery and the like which constitutes the subject of this invention, together with a view by sections of the part of a mesh forming part of a shelf and a rectangular foot for the completion of the lower end.

In view of these Figure one can note how the suggested system is based on the use of identical modules (1), ideally molded in an appropriate plastic material, flattened, comprising a large open area (2) which reduces its weight as well as the amount of material used in same without reducing its structural rigidity, the module (1) being of a length which relates to the distance which is envisaged between shelves (3) and which ideally is in the region of 5 cm., although obviously this figure can vary depending on the specific requirements of each practical situation without affecting the essence of the invention.

Each module (1) has at its top a pair of horizontal protrusions (4) which point inward and on which there are parallel and horizontal blind slots and holes (5) to accommodate the rods (6) which form part of the corresponding shelving (3). As previously indicated, these slots (5) should ideally have a cut (7) along their shanks which would allow them to be elastically deformable and facilitate a more secure fitting of the rods therein under pressure.

Figure 2:
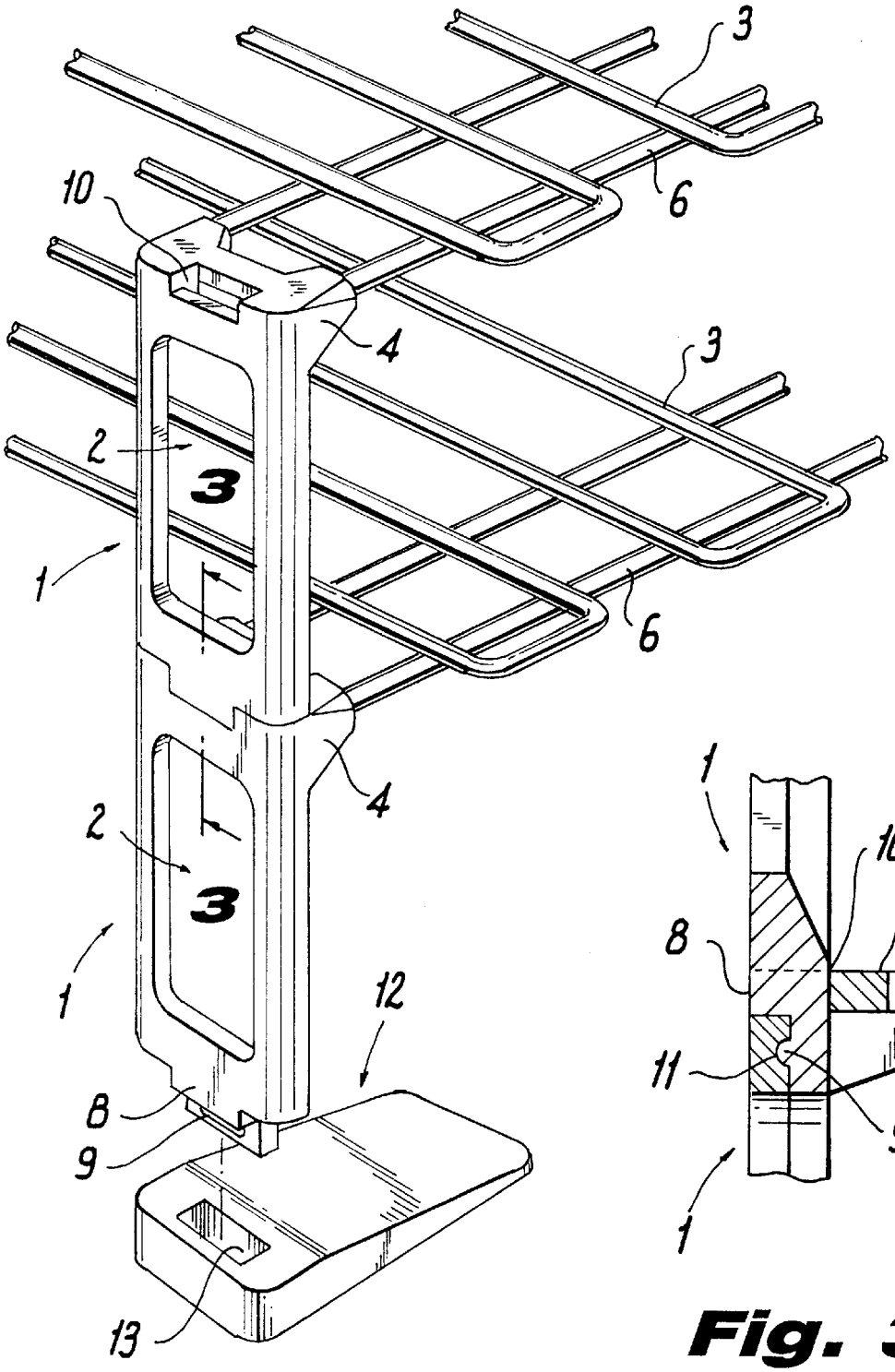
FIG. 2: Shows an opposite view to that in the preceding diagram of a pair of modules duly attached to each other, facing the corresponding rectangular foot and showing a partial view of the corresponding shelves duly affixed.
Figure 3:
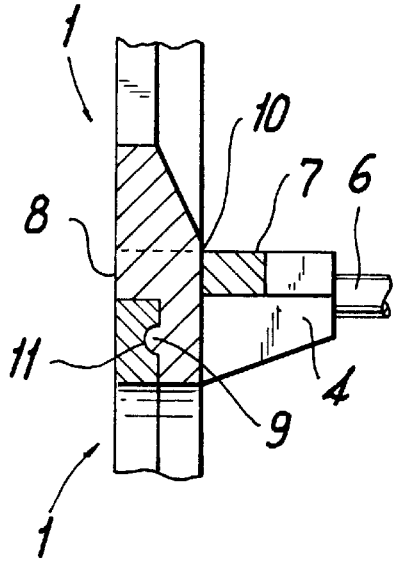
FIG. 3: Shows a section in detail of the linkage between two super-imposed modules, in accordance with cross-section a–b in FIG. 2.
Figure 5:
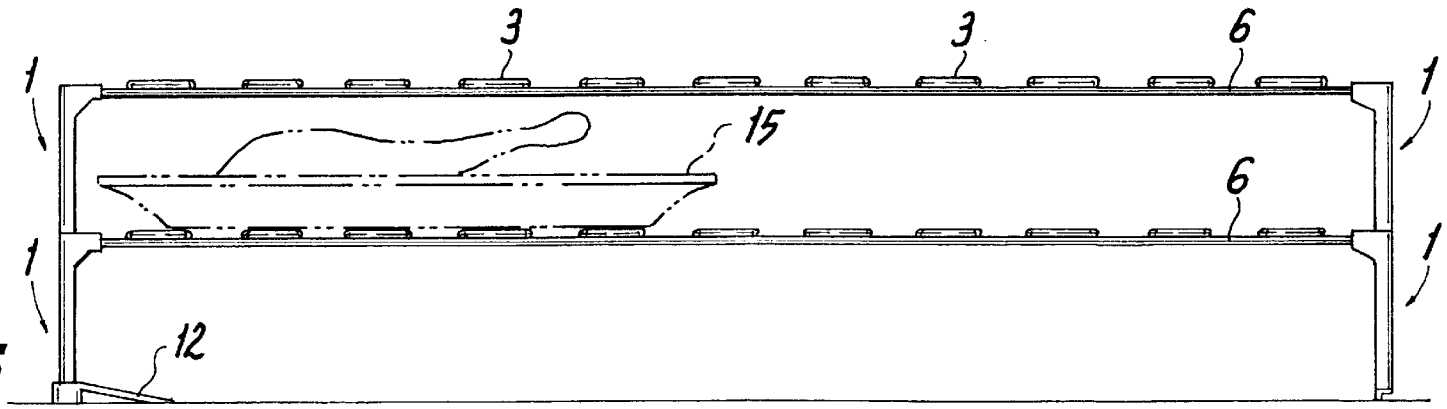
FIG. 5: Shows, finally, the frontal elevation of the unit illustrated in the preceding FIG. 4, but one should highlight that the number of shelves, which in the said Figure is two, can be increased to any reasonably required level.

On the other hand, for the tongue and groove coupling of modules (1) forming a continuous rack as can be seen from FIGS. 2 and 5, each module has at the bottom an appendage with a graduated front (8), and on whose graduations there is a lateral protrusion (9), while at the top there is a slot (10) to house the said appendage, and in the center of same fissure (11) to which the protrusion (9) fits as a clip through elastic expansion, giving rise to a stable coupling which nevertheless allows a simple dismantling of the structure through the simple pulling of one module (1) away from another.

The structure described above is complemented by a rectangular foot 12 intended to complete the bottom of each of the vertical stacks or continuous racks built with modules (1), each such rectangular foot 12 having, for its attachment to the rack (1), (1) . . . , a slot (13) similar to the slot (10) belonging to the aforementioned modules (1) and in which there is likewise a lateral and interior fissure (14) similar to the aforesaid fissure (11) and with the same purpose of housing and holding the module (1) immediately above through the latter's clip (9).

Figure 4:
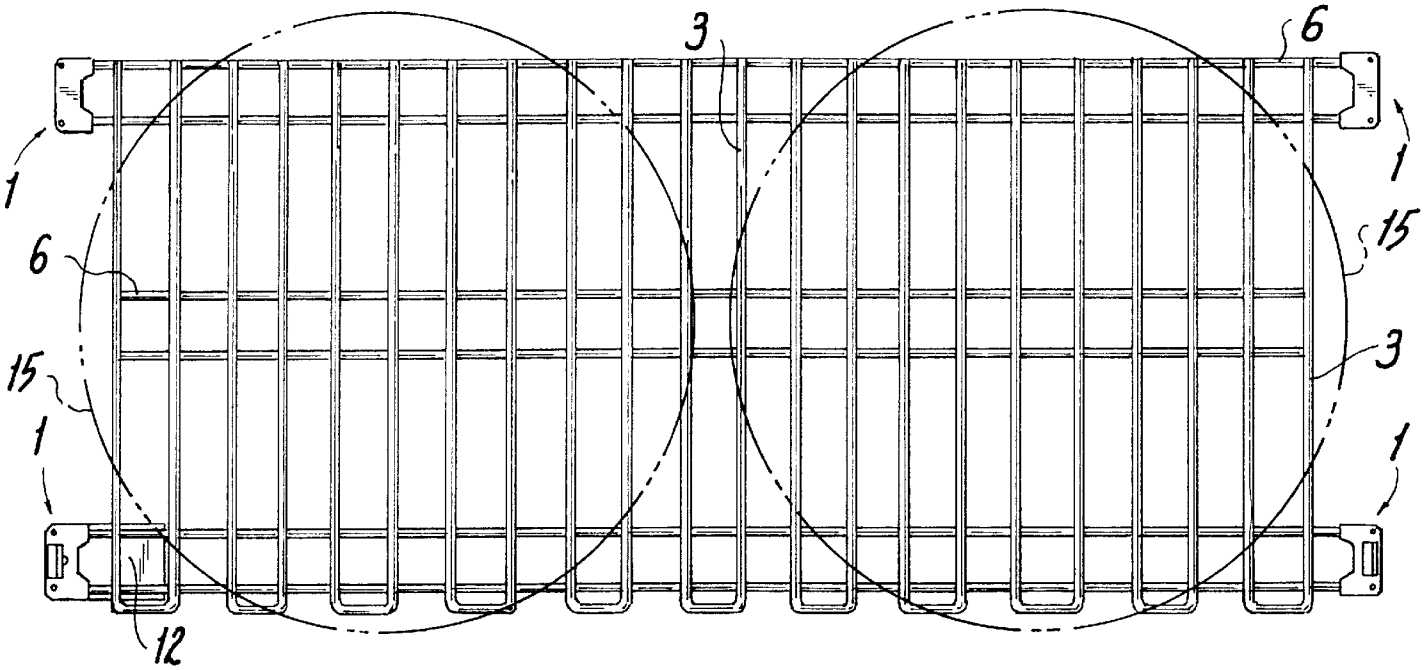
FIG. 4: Shows a general view of a multiple shelving unit built in accordance with the mounting system which is the subject of this invention, in which two circular plates are shown placed on one of the shelves.

In this way, as can be seen in particular from FIGS. 4 and 5, a light structure is achieved, with a high capacity for the storage of crockery, for example plates (15), with a structure which is easily assembled and dismantled, and which, as a result, easily allows the adaptation of the number of shelves in the structure to the requirements of any particular situation, whether this relates to the fitting of the multi-shelf structure in a refrigerator, freezer or the like, or whether what is required is the increase of storage capacity over any flat surface.

It is considered that it is not necessary to expand this description for any expert in this field to understand the scope of the invention and the advantages of same.

The materials, shape, size and arrangements of the elements are subject to change provided always that this does not imply a change in the purpose of the invention.

The provisions of this memo should always be interpreted in a wide and not limiting sense.

What is claimed is:

1. A system for the mounting of shelving comprising a first module of a plurality of modules having means for vertical attachment at respective top and bottom surfaces thereof, for vertically moving while attaching and detaching said first module to a second module of said plurality of module to form a continuous vertical stack of said plurality of modules acting as a support for at least one shelf, said first module and said second module each having means for laterally attaching said at least one shelf to each said module of said plurality of modules; wherein the means for vertical movement and attachment for vertically attaching and detaching comprises a graduated front at the bottom end of each said module of said plurality of modules, with a small lateral protrusion on said graduated front acting as a clip and a slot at the top end of said module for receiving the graduated front of the module immediately above, there being a lateral fissure in the hollow of said slot for the housing of the protrusion as a clip, and said module immediately above can be assembled or dismantled by pressure.

2. A system as in claim 1, further comprising a rectangular leg having a slot for receiving the graduated front of the module immediately above, so that the said rectangular leg and said module immediately above can be assembled or dismantled by pressure.

3. A system for the mounting of shelving comprising a first module of a plurality of modules having means for vertical attachment for vertically attaching and detaching said first module to a second module of said plurality of modules to form a continuous vertical stack of said modules acting as a support for at least one shelf, said first module and said second module each having means for laterally attaching said shelf to said module, wherein said means for laterally attaching said shelf to each said module comprises a pair of lateral protrusions having respective blind orifices with fissures along their shanks for receiving a rod of said shelf and for allowing elastic deformation of said protrusions for anchoring said rod in said orifice.

4. A system as in claim 3, further comprising a rectangular leg having a slot for receiving a graduated front of a module of said plurality of modules above, so that the said rectangular leg and said module immediately above can be assembled or dismantled by pressure.

5. A system as in claim 2, wherein the means for vertical attachment for vertically attaching and detaching comprises a graduated front at the bottom end of said module, with a small lateral protrusion on said graduated front acting as a clip, and a slot at the top end of said module for receiving the graduated front of the module immediately above, there being a lateral fissure in the hollow of said slot for the housing of the protrusion as a clip, so that the said module and said module immediately above can be assembled or dismantled by pressure.

6. A system as in claim 3, further comprising a rectangular leg having a slot for receiving the graduated front of the module immediately above, so that the said rectangular leg and said module immediately above can be assembled or dismantled by pressure.

* * * * *